US012808107B2

(12) United States Patent
Ang

(10) Patent No.: US 12,808,107 B2
(45) Date of Patent: Nov. 24, 2026

(54) LAUNDRY APPARATUS

(71) Applicant: Shane Wan Quan Ang, Singapore (SG)

(72) Inventor: Shane Wan Quan Ang, Singapore (SG)

( * ) Notice: Subject to any disclaimer, the term of this patent is extended or adjusted under 35 U.S.C. 154(b) by 95 days.

(21) Appl. No.: 18/741,360

(22) Filed: Jun. 12, 2024

(65) Prior Publication Data

US 2025/0129534 A1 Apr. 24, 2025

(30) Foreign Application Priority Data

Oct. 24, 2023 (SG) ..... 10202303004X

(51) Int. Cl.
*D06F 34/18* (2020.01)
*D06F 33/56* (2020.01)
*D06F 33/63* (2020.01)

(52) U.S. Cl.
CPC ..... *D06F 34/18* (2020.02); *D06F 33/56* (2020.02); *D06F 33/63* (2020.02)

(58) Field of Classification Search
CPC ..... D06F 17/04; D06F 27/00; D06F 33/56; D06F 33/63; D06F 34/18; D06F 58/10; D06F 58/12; D06F 58/14; D06F 73/00; D06F 73/02; D06F 87/00; D06F 95/00
See application file for complete search history.

(56) References Cited

U.S. PATENT DOCUMENTS

| | | | | |
|---|---|---|---|---|
| 7,060,106 | B2 | 6/2006 | Kleker | |
| 7,089,768 | B2 | 8/2006 | Bolduan et al. | |
| 2014/0223973 | A1* | 8/2014 | Alrefaei | A47G 25/14 223/51 |

FOREIGN PATENT DOCUMENTS

| | | | | |
|---|---|---|---|---|
| CN | 208980939 U | * | 6/2019 | |
| CN | 112011984 A | * | 12/2020 | A47L 25/005 |
| EP | 1349976 B1 | * | 12/2006 | D06F 18/00 |
| KR | 20060008458 A | * | 1/2006 | D06F 58/30 |
| KR | 20070109319 A | * | 11/2007 | D06F 73/02 |

OTHER PUBLICATIONS

Machine Translation of Xu, CN-112011984-A, Dec. 2020. (Year: 2020).*
Machine Translation of Hu et al., CN-208980939-U, Jun. 2019. (Year: 2019).*
Machine Translation of Hong, KR-20070109319-A, Nov. 2007. (Year: 2007).*
Machine Translation of Bolduan et al., EP-1349976-B1, Dec. 2006. (Year: 2006).*
Machine Translation of Ahn, KR-20060008458-A, Jan. 2006. (Year: 2006).*

* cited by examiner

*Primary Examiner* — David G Cormier
(74) *Attorney, Agent, or Firm* — Preston Smirman; SMIRMAN IP LAW, PLLC

(57) ABSTRACT

A laundry apparatus that includes a housing and one or more panels within the housing, each with at least one surface provided with one or more nozzles facing an article to be treated by fluid discharged by the nozzles, wherein the panels are configured to be movable by a moving mechanism to adjust their distance from the article.

13 Claims, 3 Drawing Sheets

LAUNDRY APPARATUS

CROSS-REFERENCE TO RELATED APPLICATION

The instant application claims priority to Singapore patent application Ser. No. 10202303004X filed Oct. 24, 2023, the entire specification of which is expressly incorporated herein by reference.

FIELD OF INVENTION

This invention relates to a laundry apparatus. In particular, a laundry apparatus with washing and drying functions.

BACKGROUND OF THE INVENTION

Conventional washing and drying apparatuses have a tumble drum for accommodating articles to be washed and dried. The drum is rotatable to give even dispersal of water, and heat. Apart from producing undesired noise and vibration during the wash and drying cycle, issues of the drum are likely to emerged over time, such as worn-out drum bearings and drive belt, leaking drum, damage in the interior of the drum, and drum misalignment which can lead to malfunctions of the washing machine and ineffective washing and drying of the articles.

However, the biggest concern of users could be the condition of the articles that are treated by such washing and drying apparatus. Tangling and wrinkling of the articles are common issues caused by overloading or unbalanced load inside the drum, mixing of heavy and lightweight fabrics in the same load, loose agitator, and aggressive washing cycles. Further, as the articles are spun around, the articles rub against each other and essentially scrubbing each other. If the article is made of fabric, rubbing of the article may cause bobbles that are damaged fibers. In addition, snaps, hooks, and catches on the articles can cause damage to other parts of the same article, other articles, or the drum. Solid materials that are mistakenly inserted into the drum such as being left inside the pockets of the articles may also cause similar damages to the articles and the washing machine. Tearable materials like tissue can break down during the wash cycle, releasing lint and paper residues that can adhere to the articles, making them look unkempt, and the residues may also clog the drainage system of the washing machine.

Therefore, a variety of washing and drying apparatuses in which clothes may be hung and processed, without the use of rotatable drum are introduced. An example is disclosed in U.S. Pat. No. 7,060,106B2 that describes a device for washing and drying garments or other items in a single unit. The garments or other items are placed in the device on hangers with space therebetween. A manifold with arms extends on each side of the items, in which the manifold is movable vertically so that the arms can move along the length of the items to be treated. The arms have one set of pipes that spray wash water, rinse waters, and other washing liquids on the items. Further, the arms have another set of pipes that carry air to the items, drying the items. After the cycle is completed, the clothes or other items may be left in the device until needed.

U.S. Pat. No. 7,089,768B2 reveals a cabinet-shaped washing machine that uses a conveyor belt to move laundry goods in circulation, with the laundry goods passing through various successive steps of the laundry cycle that includes the actual washing process, a downstream pre-dehumidification as well as a drying and pressing phase within the same housing of the machine.

Since U.S. Pat. No. 7,060,106B2 utilizes a movable manifold to discharge washing liquids on different parts of the garments or other items to be cleaned as the manifold moves, the entire garment is not subjected to treatment at the same time which can cause uneven disperse of water and distribution of heat. Further, the distance between the arms is fixed which restricts the applicable garments or items with high thickness that affects the movement of the manifold and effectiveness of washing and drying. On the other hand, U.S. Pat. No. 7,089,768B2 requires a housing with large space to allow the laundry goods to circulate therein to pass through different steps of the laundry cycle. Considerations have to be made to the applicable sizes and weight of the laundry goods as they may affect the circulating movement and each part of the housing for the different treatment processes have to possess sufficient space to accommodate the laundry goods.

The present invention is introduced to provide a laundry apparatus that addresses all the above-mentioned issues.

SUMMARY OF THE INVENTION

The main object of the present invention is to provide a laundry apparatus that carries out treatment process for one or more articles to be treated. The treatment includes any one or combination of washing, rinsing, soaking, drying and scenting the articles. In particular, the treatment does not require rotating of the articles that will cause damage, tangling and wrinkling of the articles. Another object of the present invention is to provide a laundry apparatus that effectively and evenly treats the articles, in which at least a substantial part or the entire article can be treated at the same time through the use of one or more panels with nozzles distributed thereon that discharge fluid to treat the substantial part or the entire article. Each panel can be used for discharging different fluids for various processes or treatment of one laundry cycle.

Further another objection of the present invention is to provide a laundry apparatus that allows various thickness of the articles to be applied, in which the panels are movable depending on the thickness of the article to provide an effective space for treatment of the article. The laundry apparatus offers sufficient space for the article to be hung and suitable distance for fluid, especially pressurized fluid to be applied onto the article accordingly. In addition, the present invention also aims to provide a space saving laundry apparatus that focuses on efficiency and optimal space utilization, in which two or more panels are arranged in an array, and each array of panels are organized in a vertical configuration to accommodate more articles in one single unit of the laundry apparatus. Also, there is no need to allocate space for the articles to circulate within the laundry apparatus and no requirement for additional assemblies to perform different treatments that consume space.

At least one of the preceding objects is met, in whole or in part, by the present invention, in which the present invention provides a laundry apparatus that comprises a housing; and one or more panels within the housing, each with at least one surface provided with one or more nozzles facing an article to be treated by fluid discharged by the nozzles; wherein the panels are configured to be movable by a moving mechanism to adjust their distance from the article.

In one of the embodiments of the invention, the moving mechanism comprises a rod connecting the panels and providing at least one track to allow the panels to move therealong; and an actuator to control movement of the panels.

According to a preferred embodiment of the invention, the laundry apparatus further comprises a sensor for detecting thickness of the article.

Preferably, the moving mechanism is configured to move the one or more panels according to the detected thickness of the article positioned adjacent one panel, or between two panels.

It is preferred that the article is suspended from the moving mechanism by a hanger.

Preferably, the laundry apparatus further comprises a water supplying system for supplying fluid in the form of water to be discharged from the nozzles, wherein the water supplying system includes a water source, and a pump for controlling pressure of the water.

Based on a preferred embodiment, the housing is formed with a detergent inlet for receiving detergent.

In a preferred embodiment, the system further comprises a heating system that includes a heater and a compressor for supplying heated fluid in the form of air into the housing through the nozzles.

According to a preferred embodiment, the housing is provided with a fragrance product receiver at a position after the heating system with respect to an ingress direction of the heated fluid into the panels.

Preferably, the laundry apparatus comprises at least one array of panels that each includes two spaced apart panels which are at least substantially vertically positioned in a parallel manner.

It is preferred that the laundry apparatus comprises two or more array of panels that are arranged in a vertical configuration.

Based on the preferred embodiment, each panel is internally formed with a fluid supply compartment to accommodate the fluid to be discharged from the nozzles.

In addition, each panel is preferred to be configured to have a plurality of nozzles arranged in a grid pattern on its surface.

Preferably, the plurality of nozzles of each panel is arranged in rows or columns with one row or column connected to an adjacent row or column by a tube.

It is preferred that the laundry apparatus further comprises a drainage system to remove unwanted water from the housing.

According to a preferred embodiment, the laundry apparatus further comprises a ventilation system to expel moisture, unwanted air, or both from the housing.

BRIEF DESCRIPTION OF THE DRAWINGS

This invention will now be described in greater detail with reference to the accompanying drawings.

DETAILED DESCRIPTION OF THE INVENTION

For a better understanding of the invention, preferred embodiments of the invention that are illustrated in the accompanying drawings will be described in detail.

Disclosed herein is a laundry apparatus 1000 used for performing treatment on one or more articles. The term 'treatment' includes various processes and actions taken to clean, maintain, or enhance the condition and appearance of the articles, such as washing, drying, and scenting of the articles. A laundry cycle in a preferred embodiment of this invention includes but not limited to the steps of washing and then drying. Although the article is preferably garments, it can also be other items that require the treatment as defined above.

Figure 1:
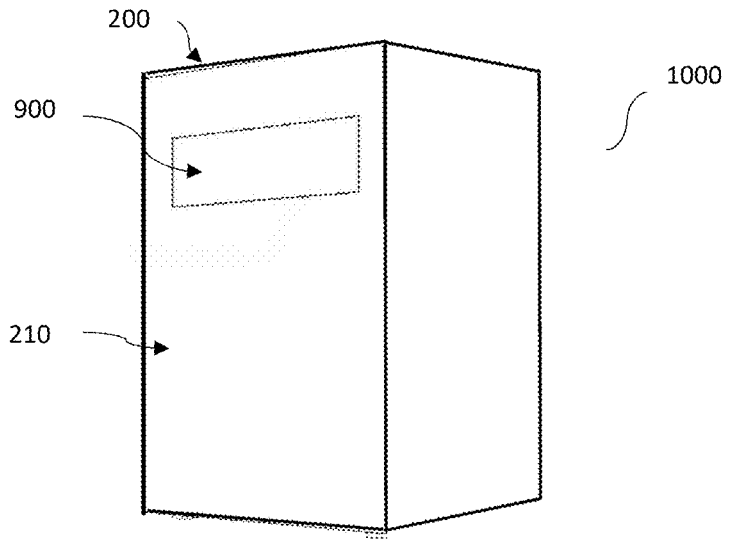
FIG. 1 illustrates a perspective view of the laundry apparatus with its door in a closed state.
Figure 2:
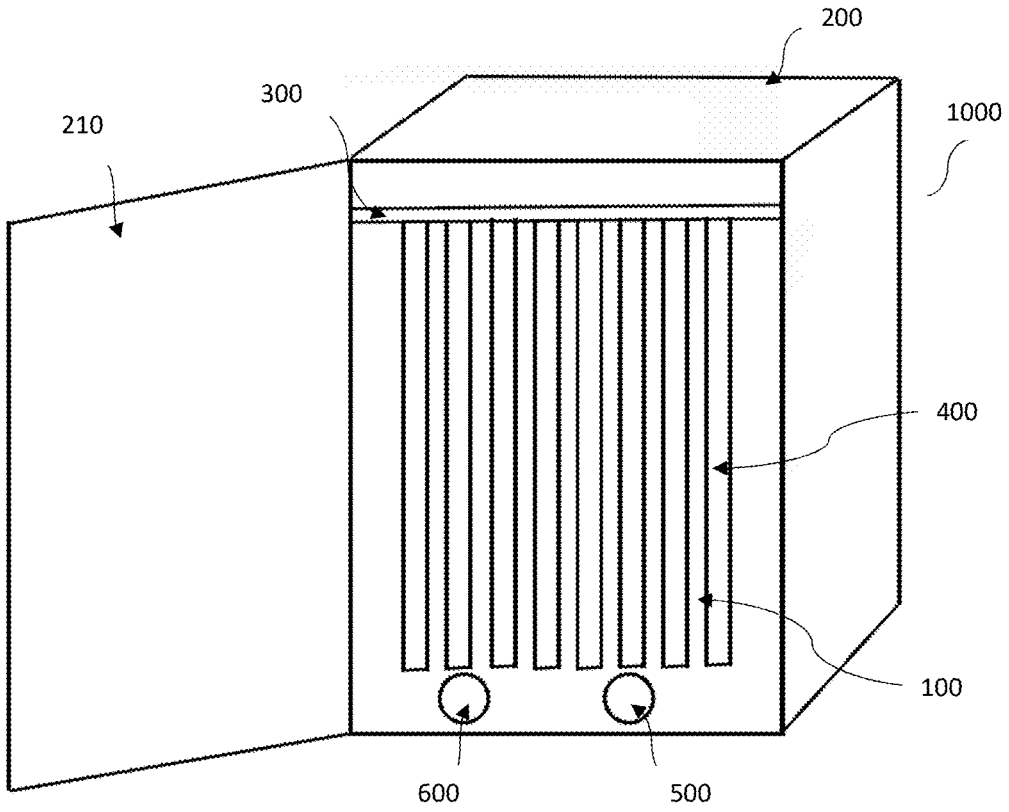
FIG. 2 illustrates a perspective view of the laundry apparatus with its door in an open state, wherein the laundry apparatus has one array of panels.
Figure 3:
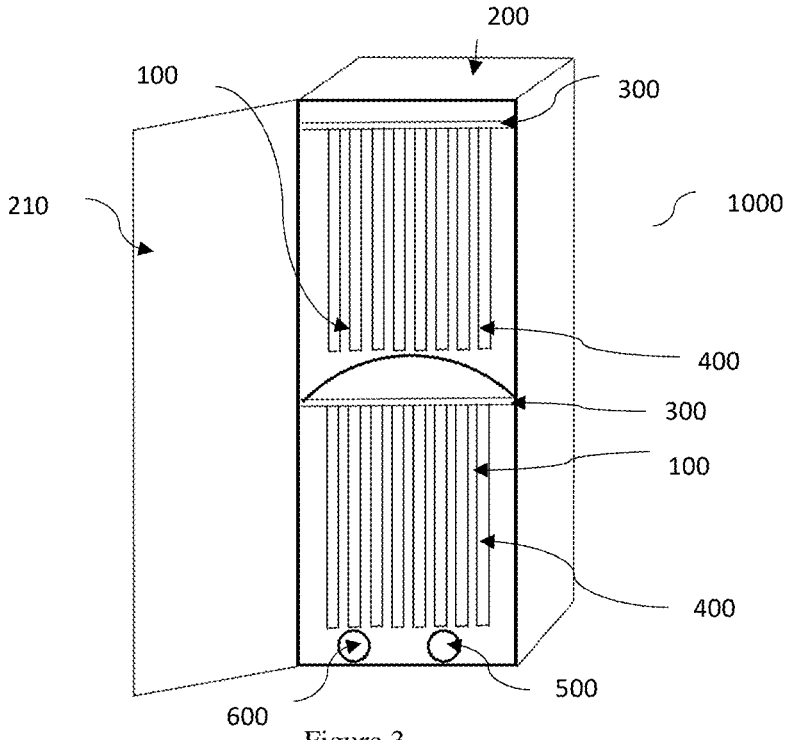
FIG. 3 illustrates a perspective view of the laundry apparatus with its door in an open state, wherein the laundry apparatus has two arrays of panels stacked in a vertical configuration where one is stacked atop another.

Referring to FIGS. 1-3, the laundry apparatus 1000 has a housing 200 with a door 210 that can allow access to the internal part of the housing 200. It is preferred that the housing 200 has a front, back, top, bottom and two side portions, in which the front portion is a front door, back portion is a back wall, top portion is a ceiling, bottom portion is a base and the two side portions are side walls. FIG. 1 shows the external appearance of the laundry apparatus 1000 where the door 200 is in a closed state. A control panel 900 is provided to allow users to configure settings of the laundry apparatus 1000 such as to select the type of treatments to be performed, the activation and deactivation of the laundry apparatus 1000 to carry out the laundry cycle, duration of each treatments or the laundry cycle, water volume, water pressure, water temperature, heated air temperature, pressure of heated air, and other adjustments of parameters that relate to the processes of the treatment.

FIGS. 2 and 3 illustrate the laundry apparatus 1000 with the door 210 in an open state for loading and unloading the articles to be treated. The door 210 is preferably installed at the front portion of the laundry apparatus 1000 and is in the form of a swing door. The housing 200 has a cavity therewithin for the treatment to be performed on the articles. The laundry apparatus 1000 is provided with one or more panels 400 with at least one surface provided with one or more nozzles 410 to discharge fluid for treating the article, in which is article is positioned adjacent to the nozzles 410 of one panel 400 at a predetermined distance that allows sufficient space to accommodate the article, preferably without the need to fold or entangle the article. The one or more panels 400 are vertically positioned and held by a rod 300 that is mounted to the inner walls of the housing 200. It is preferred that the rod 300 is mounted to the top portion of the inner side walls of the housing 200, where the panels 400 are suspended from the rod 300 with their surfaces facing the side walls of the housing 200. The panels 400 extend from top towards bottom of the cavity, leaving some space at the bottom of the cavity for accommodating unwanted fluid, such as unwanted water before it is discharged out of the housing 200. The articles are each hung onto the rod 300 by a hanger and preferably with the article being oriented in a position where its front and back surfaces facing the surface of the panels 400. Should the article be a garment, the hanger can be a clothes hanger.

In a preferred embodiment of the present invention, the laundry apparatus 1000 comprises at least one array of panels that each includes two spaced apart panels 400 which are at least substantially vertically positioned in a parallel manner. The space in between every two adjacent panels 400 must be sufficient to have at least and preferably one article positioned therebetween with a suitable predetermined distance between the article and the nozzles 410. In a situation where the article is positioned between two adjacent panels 400, both panels 400 can have a surface with nozzles 410 facing the article where fluids are respectively discharged from opposing directions towards the opposing portions of the article, such as the front and back portions of the article. It is also possible to have just one panel 400 with its nozzles 410 facing the article where the fluid is applied to the article in a single direction. FIG. 2 shows an example of the laundry apparatus 1000 that has one array of panels.

In an embodiment of the laundry apparatus with two or more array of panels 400 like the one shown in FIG. 3, the arrays of panels 400 are positioned one atop another in a vertical configuration in which one array of panels 400 is stacked on top of another array of panels 400 such that the laundry apparatus 1000 has more than one level of panels 400. Each level of the panels 400 can be accommodated within its own compartment which can be separated by a divider. The panels 400 extend from top towards bottom of each compartment, leaving space at the bottom for accommodating unwanted fluid, such as unwanted water before they are discharged out of the housing 200. To provide substantial or preferably full coverage of treatment onto the article, each panel 400 has a size similar to or larger than the average size or the possible largest of articles to be cleaned. In particular, the distribution of nozzles 410 takes up an area that is similar to or larger than the average surface area or the possible largest surface area of the articles to be cleaned, in which the surface area is the part of the article that faces the nozzles 410.

A moving mechanism is incorporated to the laundry apparatus 1000 that allows the panels 400 to be movable along the rod 300. The moving mechanism comprises the rod 300 connecting the panels 400 and providing at least one track that defines a movable path for the panels 400 to allow the panels 400 to move therealong; and an actuator to control movement of the panels 400. A single track can be provided along the rod 300 to allow one panel 400 to move along the entire track, or more than one panel 400 of the same array can be configured to move along the same track. In another embodiment, each panel 400 can be provided with its own track on the rod 300, such that the panel 400 has a restricted movable path. In yet another embodiment, there is at least one track that is each provided for a single panel 400, while there is at least another track that is each shared by more than one panel 400. As for the actuator, it can be driven by various power sources, including electric, pneumatic, hydraulic, or piezoelectric systems to enable linear motion of the panels 400 along the track.

The laundry apparatus 1000 further comprises a sensor for detecting thickness of the article. Examples of applicable sensors include but not limited to capacitive sensors, laser sensors, and the like. The moving mechanism is configured to move one or more panel 400 according to the detected thickness of the article positioned adjacent one panel 400, or between two panels 400 for keeping the predetermined distance between the article and an adjacent panel 400.

A water supplying system is provided to supply fluid in the form of water in a water supply line to treat the articles. According to FIG. 4, the water supplying system may include a water source 710, and a pump 720. The term "water source" used herein may indicate a local water source or components that allow water from an external water source to be directed into the laundry apparatus 1000. The components may include a hose connected to a water faucet or valve. On the other hand, the pump 720 is used to increase pressure of the water, and transport water from one location to another by creating flow. The water supply must have sufficient water pressure to feed the laundry apparatus 1000. Adequate water pressure is necessary for the laundry apparatus 1000 to conduct the washing process with water at a desired rate. A pressure regulator may be added to the water supplying system to control and reduce water pressure to a predetermined level.

A piping system is used to connect the water supplying system to the panels 400 to supply water. Preferably, the piping system comprises a main pipe, a first pipe branching from the main pipe that connects to the water supplying system, and multiple smaller pipes branching from the main pipe that are respectively connected to the panels 400. Alternatively, the piping system comprises a water pipe connecting the water supplying system to each panel 400, or the water pipe connects in between the water supplying system and the panel 400 that is nearest to the water supplying system such that the water passes through one panel 400 to a subsequent panel 400 in a sequential order until the last panel 400. It should be noted that other arrangement and structure of the piping system are also applicable as long as water flows from the water supplying system to the panels 400 can be conducted. Inside the laundry apparatus 1000 along the water supply line, water inlet valves can be provided to control water flow into the laundry apparatus 1000 and/or one or more panels 400. When a washing process begins, the valves are opened to allow pressurized water to enter the laundry apparatus 1000.

Figure 4:
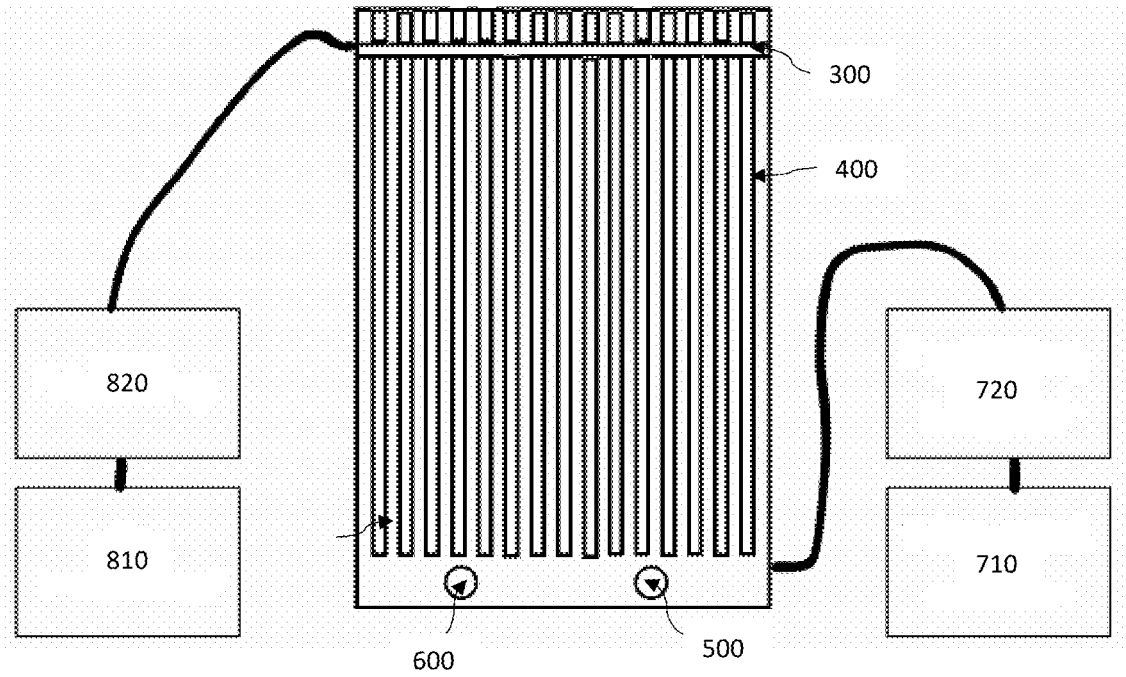
FIG. 4 is a schematic diagram illustrating the connection of water supplying system and heating system to the panels.

The laundry apparatus 1000 may comprise a built-in dispenser for detergent. An exemplary dispenser has one or more compartments for detergent and optionally fabric softener. Referring to FIGS. 2-4, the laundry apparatus 1000 is formed with a detergent inlet 500 as part of the dispenser for receiving the detergent. Additionally, the laundry apparatus 1000 may be formed with a softener inlet as part of the dispenser for receiving the fabric softener. In the process of washing, the pressurized water is used to mix with detergent and/or fabric softener in which the mixture is dispensed into the panels 400 through the piping system to be discharged out of the panel 400 to interact with the article.

To enable drying of the articles to be performed, a heating system is provided. As shown in FIG. 4, the exemplary heating system includes a heater 810 and a compressor 1000 for supplying heated fluid in the form of air into the housing 200 through the nozzles 410. The heater 810 heats air flowing into the laundry apparatus 1000, whereas the compressor 820 is used for producing compressed heated air to enable rapid drying through high-velocity discharge of the heated air, and uniform drying across the surface of the article to reduce moisture retention or uneven drying. The compressed heated air can be used to blow off excess moisture or particles from the surface of the article with precision drying which may allow air with lower temperature to be used for drying the article. The pressure of the compressor 820 can be adjusted, either manually or automatically, depending on the type of compressor 820 and its control system.

The heated air, whether it is compressed or not, can be supplied from the heating system through a heated air supply line into the panels 400 through the same piping system as the one used for water flow as described above, or a different piping system used for air flow. In a situation where the same piping system is utilized, there is a second pipe branching from the same main pipe, that is connected to the heating system, such that the heated air can be supplied to each panel 400 through the same smaller pipes that branched from the main pipe. Alternatively, a different piping system may be applied that comprises an air pipe connecting the heating system to each panel 400 through small pipes branching from the air pipe, or an air pipe that connects between the heating system and the nearest panel 400 such that the heated air passes through one panel 400 to a subsequent panel 400 in a sequential order until the last panel 400. It should be noted that other arrangement and structure of the piping system are also applicable for the air flow from the heating system to the panels 400.

To allow the scenting process to be performed, the housing 200 is provided with a fragrance product receiver 600 as illustrated in FIGS. 2-4. The fragrance product can be a fragrance pod, a laundry scent booster or scent beads, that are designed to add a pleasant fragrance to the article and possibly also the laundry apparatus 1000. The fragrance product works by releasing the fragrance contained therein, for example in the pods as the laundry cycles progress. Since it is preferred that the fragrance product receiver is positioned after the heating system with respect to an ingress direction of the heated fluid into the panels 400 through the heated air supply line, the fragrance product releases the fragrance contained therein to be mixed with the heated air such that the scenting process can be performed concurrently with the drying process of the article. However, scenting can also be performed during the washing process. When the fragrance product is exposed to water, the fragrance is released to the water that will be dispersed to the article. For example, water dissolves the outer layer of the fragrance pod, releasing the fragrance into the water, causing the scent to be infused into the article as it is being washed. During rinsing, any remaining traces of the fragrance are further distributed within the housing as the article is rinsed.

Figure 5:
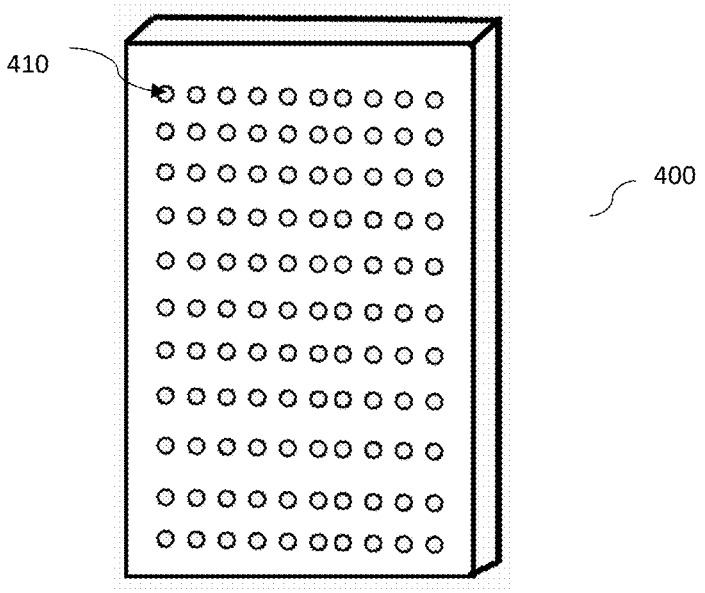
FIG. 5 illustrates a perspective view of a panel with nozzles provided in a grid pattern.
Figure 6:
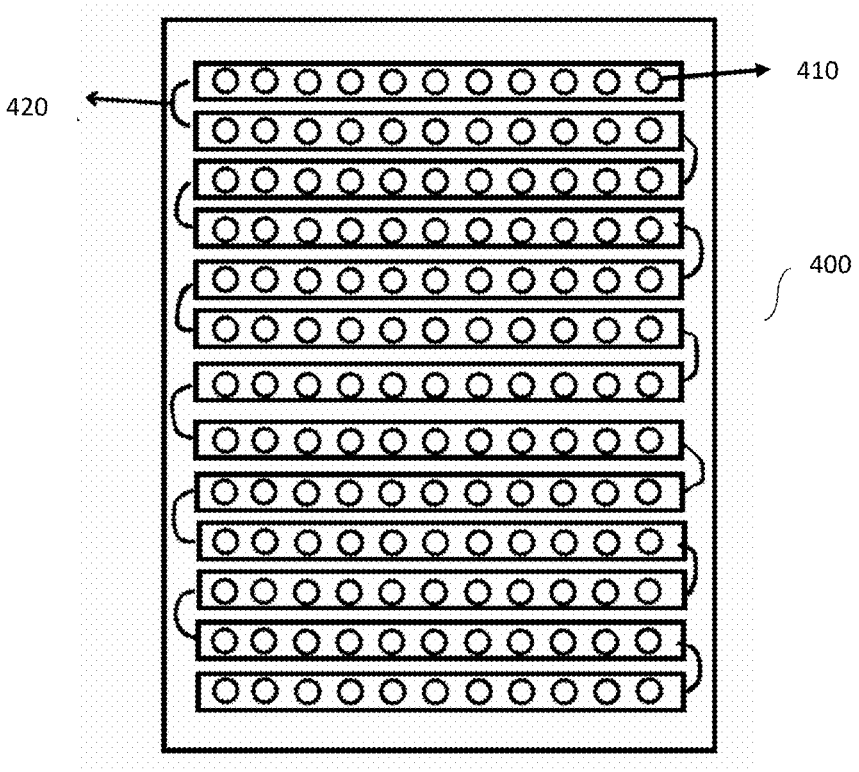
FIG. 6 is a front inner view of a panel with nozzles arranged in rows that are connected by tubes.

With reference to FIGS. 5 and 6 that respectively show a preferred embodiment of the panel, it has a plurality of nozzles 410 arranged in a grid pattern on one of its surfaces. Although it is not shown in any of the accompanying figures, the opposing surface of the panel 400 may also be formed with one or more nozzles 410. In particular, the grid pattern resembles a dot grid pattern that is characterized by rows and columns of equally spaced and aligned nozzles. A row or column of the nozzles 410 may be connected to its adjacent row or column with tubes within the panel 400. As depicted in FIG. 2, multiple tubes 420 can be seen connecting every two adjacent rows in an alternate position. For example, the first tube connects the first and second rows at the left side, indicating fluid flow from the right side of the first row towards the left side and enters the left side of the second row through the first tube; whereas the second tube connects the second and third rows at the right side, indicating fluid flow from the left side of the second row towards the right side and enters the right side of the third row through the second tube. The tubes 420 are arranged in such an alternate manner until the fluid is supplied to the final row. It should be noted that the positioning such as "left" and "right" are merely examples to explain the flow of the fluid, and the installation of the tubes 420 are not restricted to such positions.

The nozzles 410 are designed to control and direct the flow of the fluid, be it the water or the heated air as it exits the internal of the panels 400. Nozzles 410 are used to control the rate and direction of fluid flow, as well as accelerate the flow of a fluid by narrowing the passage of the nozzles 410 through which the fluid 410 passes. Hence, the nozzles 410 are suitable to be used in the laundry cycle for washing and drying applications. For example, in the washing process, water jet which is a stream or jet of water can be propelled at a high velocity through each nozzle 410 to direct a high-speed stream of water or cleaning solution which is the mixture of water and detergent, that may also be added with fabric softener, for removing dirt, debris, or contaminants.

Each panel 400 is internally formed with a fluid supply compartment to accommodate fluid to be discharged from the nozzles 410. Since the panels 400 are preferably hollow with a space therewithin, the fluid supply compartment may be the space inside the panel that are linked to the nozzles 410 such that fluid within the fluid supply compartment can be discharged from the nozzles 410 towards the article to be treated. In another preferred embodiment of the laundry apparatus 1000 that has piping system that connects the water supplying system and heating system to just one panel 400, in which the panels 400 of the same array are required to transfer fluid to a subsequent panel 400, the panels 400 may be internally formed with a fluid transfer conduit or compartment to allow fluid to flow from one panel to the other until the last panel 400 that has one or more panel fluid outlets that can be a panel water outlet and/or panel air outlet. The piping system is configured to allow fluid to be supplied into both the fluid supply compartment and the fluid transfer conduit or compartment of each panel 400.

The laundry apparatus 1000 further comprises a drainage system having an apparatus water outlet formed at the housing 200 to remove unwanted water from the housing 200. The unwanted water can be water used to treat the articles. An external hose can be connected to the apparatus water outlet to direct the unwanted water to a destination to dispose the unwanted water. For a laundry apparatus 200 with two or more levels that are divided into compartments by dividers, the dividers may be formed with compartment water outlets to direct the unwanted water to the apparatus water outlet, in which the compartment water outlets can be connected to the apparatus water outlet by a conduit or the unwanted water may allow the unwanted water to freely flow from the compartment water outlet into the apparatus water outlet. For a laundry apparatus 1000 with two or more levels without the dividers, the unwanted water is free to fall to the bottom of the cavity to be released out of the housing 200 through the apparatus water outlet.

Each panel 400 may be formed with the panel water outlet to remove unwanted water within each panel 400. For connected panels 400 where the fluid is transferred from one panel 400 to another until the last panel 400, the last panel 400 is formed with the panel water outlet to remove unwanted water from all panels 400 of the same array. The water from the panel water outlet may be discharged into the housing 200 to be directed out from the apparatus water outlet. Alternatively, one or more panel water outlets can be connected to the apparatus water outlet by conduits to discharge the unwanted water out of the housing 200 without the need to release the unwanted water from the panels into the housing 200. A drainage pump may be incorporated to the drainage system to transport the unwanted water out of the laundry apparatus 1000.

Further, the laundry apparatus 1000 may also comprise a ventilation system to expel moisture, unwanted air, or both from the housing 200. To facilitate explanation of the ventilation system, the moisture and unwanted air shall hereinafter be collectively referred to as "unwanted air". The housing 200 is formed with an apparatus air outlet to discharge the unwanted air from the housing 200 to the external environment. An exhaust duct may be connected to the apparatus air outlet. For laundry apparatus 1000 with two or more levels that are divided into compartments by dividers, the dividers may be formed with compartment air outlets to direct the unwanted air to the apparatus air outlet, in which the compartment air outlets can be connected to the apparatus air outlet by a conduit or the unwanted air may allow the unwanted air to freely flow from the compartment air outlet into the apparatus air outlet. For a laundry apparatus 1000 with two or more levels without the dividers, the unwanted air is free to flow out of the housing 200 through the apparatus air outlet.

Each panel 400 may be formed with the panel air outlet to remove unwanted air within each panel 400. For connected panels 400 where the fluid is transferred from one panel 400 to another until the last panel 400, the last panel 400 is formed with the panel air outlet to remove unwanted air from all panels 400 of the same array. The air from the panel air outlet may be discharged into the housing to be directed out from the apparatus air outlet. Alternatively, one or more panel air outlets can be connected to the apparatus air outlet by conduits to discharge the unwanted air out of the housing 200 within the need to release the unwanted air from the panels 400 into the housing 200. Inside the laundry apparatus 1000, a built-in fan or blower can be added to the ventilation system that helps circulate the unwanted hot air within the laundry apparatus 400 and expels it through the exhaust duct.

In operation, the laundry apparatus 400 can be configured to run a preferred embodiment of a laundry cycle that comprises the washing and drying processes. The washing process starts with dispersing water from the nozzles 401 towards the article to wet the article and remove dirt, debris or contaminant from the article, preferably for about 1 minute. After that, detergent and optionally fabric softener as well are dissolved using water to create a soapy solution that wets and saturates the article, preparing them for the washing process. This step helps loosen dirt and stains from the article, especially those made of fabric before rinsing occur. The article that is subjected to the soapy solution for a few minutes, preferably 3 minutes which is considered the soaking process to remove the dirt, debris and contamination that can include bacteria. After that, the washing process proceeds to rinsing, where water without detergent is dispersed from the nozzles towards the article. The soapy solution is rinsed away, preferably for 1 minute. Once rinsing is completed, the unwanted water used for washing is removed from the laundry apparatus 1000 by the drainage system. The laundry cycle then proceeds to the drying process where heated air is discharged from the nozzles towards the article. Scenting can be done concurrently with the drying process in which the discharged heated air is scented. Upon completion of the drying process, the unwanted air is expelled from the laundry apparatus 1000 through the ventilation system.

Although the description above contains many specifications, it is understood that the embodiments of the preferred form are not to be regarded as a departure from the invention and it may be modified within the scope of the appended claims.

What is claimed is:

1. A laundry apparatus, comprising:

a housing;

a first plurality of panels contained within the housing, each panel with at least one surface provided with one or more nozzles facing an article to be treated by fluid discharged by the nozzles;

wherein one or more of the panels are configured to be movable by a moving mechanism to adjust their distance from the article;

wherein the moving mechanism comprises a rod connecting the panels and providing at least one track to allow one or more of the panels to move therealong;

an actuator to control movement of the panels;

a sensor for detecting thickness of the article;

wherein the moving mechanism is configured to move one or more of the panels according to the detected thickness of the article positioned adjacent one panel or between two adjacent panels for keeping a predetermined distance between the article and an adjacent panel;

a water supplying system for supplying fluid in the form of water to be discharged from the nozzles, wherein the water supplying system includes a water source, and a pump for controlling pressure of the water; and a heating system that includes a heater and a compressor for supplying heated fluid in the form of air into the housing through the nozzles.

2. The laundry apparatus according to claim 1, wherein the article is hung onto the rod by a hanger.

3. The laundry apparatus according to claim 1, wherein the housing is formed with a detergent inlet for receiving detergent.

4. The laundry apparatus according to claim 1, wherein the housing is provided with a fragrance product receiver at a position after the heating system with respect to an ingress direction of the heated fluid into the panels.

5. The laundry apparatus according to claim 1, wherein the first plurality of panels is substantially vertically positioned in a parallel manner.

6. The laundry apparatus according to claim 5, further comprising a second plurality of panels that is arranged in a vertical configuration with respect to the first plurality of panels.

7. The laundry apparatus according to claim 6, wherein each of the panels is internally formed with a fluid supply compartment to accommodate the fluid to be discharged from the nozzles.

8. The laundry apparatus according to claim 7, wherein each of the panels is configured to have a plurality of nozzles arranged in a grid pattern on its surface.

9. The laundry apparatus according to the claim 8, wherein the plurality of nozzles of each panel is arranged in rows or columns with one row or column connected to an adjacent row or column by a tube.

10. The laundry apparatus according to claim 1, further comprising a drainage system to remove unwanted water from the housing.

11. The laundry apparatus according to claim 1, further comprising a ventilation system to expel moisture, unwanted air, or both from the housing.

12. A laundry apparatus, comprising:

a housing;

a plurality of panels contained within the housing, each panel with at least one surface provided with one or more nozzles facing an article to be treated by fluid discharged by the nozzles;

wherein one or more of the panels are configured to be movable by a moving mechanism to adjust their distance from the article;

wherein the moving mechanism comprises a rod connecting the panels and providing at least one track to allow one or more of the panels to move therealong;

an actuator to control movement of the panels;

a sensor for detecting thickness of the article;

wherein the moving mechanism is configured to move one or more of the panels according to the detected thickness of the article positioned adjacent one panel or between two adjacent panels for keeping a predetermined distance between the article and an adjacent panel;

a water supplying system for supplying fluid in the form of water to be discharged from the nozzles, wherein the water supplying system includes a water source, and a pump for controlling pressure of the water; and a heating system that includes a heater and a compressor for supplying heated fluid in the form of air into the housing through the nozzles;

wherein each of the panels is configured to have a plurality of nozzles arranged in a grid pattern on its surface.

13. A laundry apparatus, comprising:

a housing;

a plurality of panels contained within the housing, each panel with at least one surface provided with one or more nozzles facing an article to be treated by fluid discharged by the nozzles;

wherein one or more of the panels are configured to be movable by a moving mechanism to adjust their distance from the article;

wherein the moving mechanism comprises a rod connecting the panels and providing at least one track to allow one or more of the panels to move therealong;

an actuator to control movement of the panels;

a sensor for detecting thickness of the article;

wherein the moving mechanism is configured to move one or more of the panels according to the detected thickness of the article positioned adjacent one panel or between two adjacent panels for keeping a predetermined distance between the article and an adjacent panel;

a water supplying system for supplying fluid in the form of water to be discharged from the nozzles, wherein the water supplying system includes a water source, and a pump for controlling pressure of the water; and a heating system that includes a heater and a compressor for supplying heated fluid in the form of air into the housing through the nozzles;

wherein each of the panels is configured to have a plurality of nozzles arranged in a grid pattern on its surface;

wherein the plurality of nozzles of each of the panels is arranged in rows or columns with one row or column connected to an adjacent row or column by a tube.

* * * * *